US005662526A

United States Patent [19]

Sutherlin

[11] Patent Number: 5,662,526

[45] Date of Patent: Sep. 2, 1997

[54] AUTOMATIC GOLF BALL TEEING MACHINE

[76] Inventor: Dave Sutherlin, 30 S. Tuxedo St., Indianapolis, Ind. 46201

[21] Appl. No.: 626,357

[22] Filed: Apr. 2, 1996

[51] Int. Cl.[6] ..... A63B 57/00

[52] U.S. Cl. ..... 473/135; 473/133

[58] Field of Search ..... 473/132, 133, 473/134, 135, 136, 137

[56] References Cited

U.S. PATENT DOCUMENTS

| | | | |
|---|---|---|---|
| 3,298,694 | 1/1967 | Turnau et al. | 473/135 |
| 3,549,152 | 12/1970 | Gentiluomo . | |
| 4,017,087 | 4/1977 | Bruno . | |
| 5,016,886 | 5/1991 | Gould | 473/135 |
| 5,145,176 | 9/1992 | Lipson . | |
| 5,282,629 | 2/1994 | Eckstein | 473/133 |
| 5,348,305 | 9/1994 | Lowe . | |
| 5,356,148 | 10/1994 | Elder, Jr. | 473/135 |
| 5,411,267 | 5/1995 | Burks et al. | 473/135 |
| 5,549,299 | 8/1996 | Brown | 473/133 |

*Primary Examiner*—Steven B. Wong
*Attorney, Agent, or Firm*—Liell & McNeil

[57] ABSTRACT

An automatic golf ball teeing machine is constructed around a housing that includes a substantially horizontal plate. A fluid pressure cylinder with an inlet and a piston above the inlet is attached to the housing under a hole in the plate. The piston is moveable between an advanced position and a retracted position, but is biased toward its retracted position. A tee is connected to the piston and is moveable with the piston between a loading position and a maximum height position in which a portion of the tee extends above the plate. A supply conduit sized to carry golf balls is attached to the housing with one end adjacent the tee when in its loading position. A source of high pressure fluid is connected to the inlet of the fluid pressure cylinder. A pressure regulating valve is positioned between the inlet and the source of high pressure fluid and is capable of adjusting pressure acting on the piston to balance the tee between its loading position and its maximum height position. A reset switch is capable of relieving pressure on the piston to allow the piston to retract under its biasing action in order to load the next available golf ball.

13 Claims, 3 Drawing Sheets

1
14
23
15
22
24
100
2
25
3
26
18
4
41
42
19
27
5
17
9
8
12
6
11
7
30
35
40
32
31
10
13

AUTOMATIC GOLF BALL TEEING MACHINE

FIELD OF THE INVENTION

The present invention relates generally to a device for automatically teeing practice golf balls, and in particular to an automatic teeing machine that allows the golfer to both re-tee a ball and adjust its height without changing their golfing stance.

BACKGROUND OF THE INVENTION

Golfers routinely spend hours hitting practice golf balls in order to improve their swing and/or perfect the use of a certain club. In typical driving range operations, the golfer gets a bucket of balls and must repeatedly loose his grip and move his feet in order to tee a ball for each successive shot. Since even a small change in grip or stance can alter a successive shot, the golfer's ability to learn from each shot and adjust the aspect of their swing accordingly is rendered more uncertain. Any device that would allow the golfer to eliminate at least some of the variables involved in golfing would allow the golfer to learn much more about their own swing and what adjustments are necessary to improve their game.

In responding to this need, U.S. Pat. No. 5,356,148 to Elder, Jr. describes a simplified mechanism for automatically teeing practice golf balls that utilizes a vertically oriented pneumatic cylinder mounted below ground with a tee attached to one end. A hopper containing a plurality of golf balls opens to the pneumatic cylinder below ground and provides another golf ball with each retraction of the pneumatic cylinder's piston. The piston is alternately advanced and retracted by alternately exposing the top surface or the bottom surface of the piston to compressed gas. While Elder, Jr. allows a golfer to automatically re-tee tee successive golf balls without the golfer having to change their stance, the height to which the golf ball is teed in the Elder, Jr. machine is not easily adjustable without undergoing a cumbersome process involving screw drivers or the like. Elder, Jr. also suffers from the drawback of not showing any means for preventing the machine from jamming or otherwise misloading when the piston is retracted to load a successive golf ball.

The present invention is intended to overcome these and other problems associated with automatic golf ball teeing machines of the prior art.

SUMMARY OF THE INVENTION

In responding to this need, the present invention provides an automatic golf ball teeing machine with a housing that includes a substantially horizontal plate. A fluid pressure cylinder with an inlet and a piston above the inlet is attached to the housing under a hole in the plate. The piston is moveable between an advanced position and a retracted position. Means such as inertia and/or a spring are provided for biasing the piston toward its retracted position. A tee is connected to the piston and is moveable with the piston between a loading position and a maximum height position in which a portion of the tee extends above the plate. A supply conduit sized to carry golf balls is attached to the housing with one end adjacent the tee when in its loading position. A source of high pressure fluid is connected to the inlet of the fluid pressure cylinder. A pressure regulating valve is positioned between the inlet and the source of high pressure fluid and is capable of adjusting pressure acting on the piston to balance the tee between its loading position and its maximum height position. Finally, a reset switch is capable of relieving pressure on the piston to allow the piston to retract under the action of the biasing means in order to reload a golf ball between shots.

One object of the present invention is to provide an improved automatic golf ball teeing machine.

Another object of the present invention is to provide an automatic golf ball teeing machine that is powered by pressurized fluid rather than electricity.

Still another object of the present invention is to provide an automatic golf ball teeing machine with an easier ability for the golfer to adjust the teed height.

Another object of the invention is to provide good reliability, less moving parts, and an infinite positioning with minimal effort.

DETAILED DESCRIPTION OF THE PREFERRED EMBODIMENTS

Figure 1:
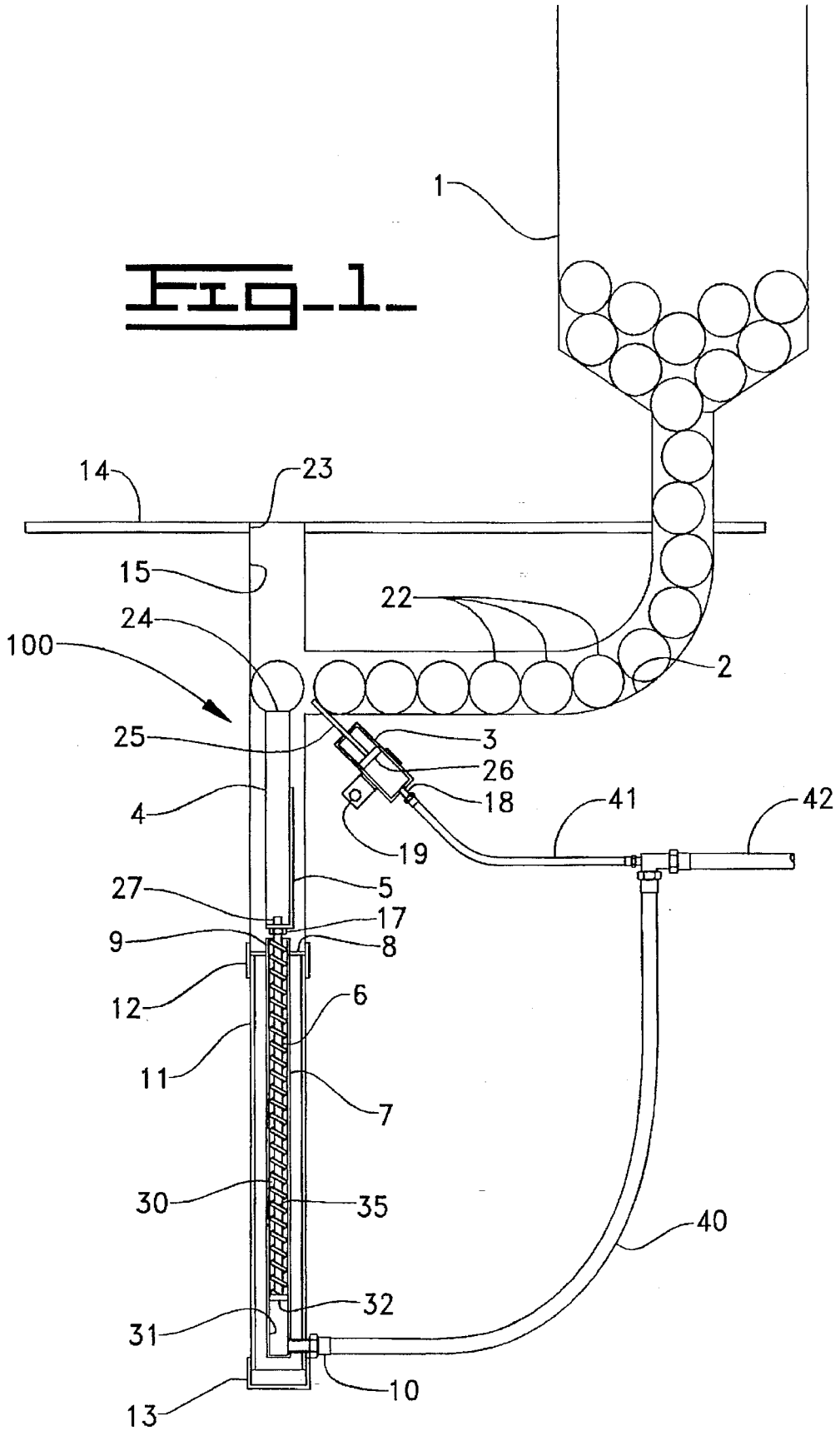
FIG. 1 is a sectioned side elevational view of an automatic golf ball teeing machine according to the preferred embodiment of the present invention.

Referring now to FIG. 1, an automatic golf ball teeing machine 100 is constructed around a housing that includes a horizontal steel plate surface 14. A hopper 1 is preferably mounted about 36 inches above plate 14 and is sized to receive a plurality of golf balls 22. The hopper keeps the golfer from having to bend over to load when loading new balls into the machine. The balls 22 are gravity fed downward under plate 14 through a supply conduit number 2. Supply conduit 2 opens to a loading chamber 15 where the balls 22 come to rest on a gum rubber wall tube 4 that serves as the tee. Tee 4 is connected to one end 27 of a piston rod 6 that is raised and lowered by pneumatic cylinder 7. Piston rod 6 is shown at its retracted position. Air enters and exists pneumatic cylinder 7 through an inlet 10 that is positioned below piston 32 which is attached to one end of the piston rod 6.

A flat washer 8 with a hole therethrough is butt welded to pipe threaded nipple 12. The head end 9 of pneumatic cylinder 7 protrudes up through the hole in flat washer 8 and is secured to nipple 12 via a nut 17, which holds the pneumatic cylinder in a vertical orientation. Pneumatic cylinder 7 is enclosed within a pipe 11 that is secured on one end to nipple 12 and on its other end to an end cap 13.

In order to prevent interference between the operation of pneumatic cylinder 7 with the remaining golf balls 22 in supply conduit 2, two methods are proposed for preventing jamming or misloading of machine 100. The first option would be to include a retainer guard 5 that holds back the remaining balls in supply conduit 2 when the piston rod 6 is moved toward its advanced position. The retaining guard 5 is mounted to end 27 of piston rod 6 and includes a portion that can be glued to the wall of tee 4 which is preferably several inches long. As piston rod 6 moves upward toward its advanced position, the retaining guard 5 holds the remaining balls in supply conduit 2 from prematurely entering loading chamber 15 or otherwise interfering with the operation of piston cylinder 7.

The preferred method of preventing misfeeds and jamming includes the use of a second pneumatic cylinder 3 which is supplied with compressed air via an inlet 18. When compressed air enters air cylinder 3, piston 26 and piston rod 25 move forward in such a way that piston rod 25 protrudes into supply conduit 2 to prevent the remaining golf balls 22 from entering loading chamber 15. Both pneumatic cylinder 7 and pneumatic cylinder 3 are commercially available from Mead Corporation. Pneumatic cylinder 3 is attached at the location shown in FIG. 1 via a bracket 19. With this structure the teeing of each successive ball is isolated from the other balls.

Piston rod 6 of pneumatic cylinder 7 is biased toward its retracted position, as shown, by a compression spring 35 which is mounted in chamber 30 above piston 32. Thus, when fluid pressure on inlet 10 is relieved, piston cylinder 6 retracts under this bias to its loading position as shown. When compressed air or another suitable fluid is supplied to inlet 10, piston cylinder 6 and hence tee 4 will rise against the action of spring 35 until the spring and the fluid pressure underneath piston 32 achieve a balance. Thus, depending on the pressure entering inlet 10, golf ball 22 resting on tee 4 can be raised through hole 23 in plate 14 to any height desired by the golfer infinite adjustability is provided by simply adjusting the fluid pressure entering pneumatic cylinder 7 at inlet 10.

Figure 2:
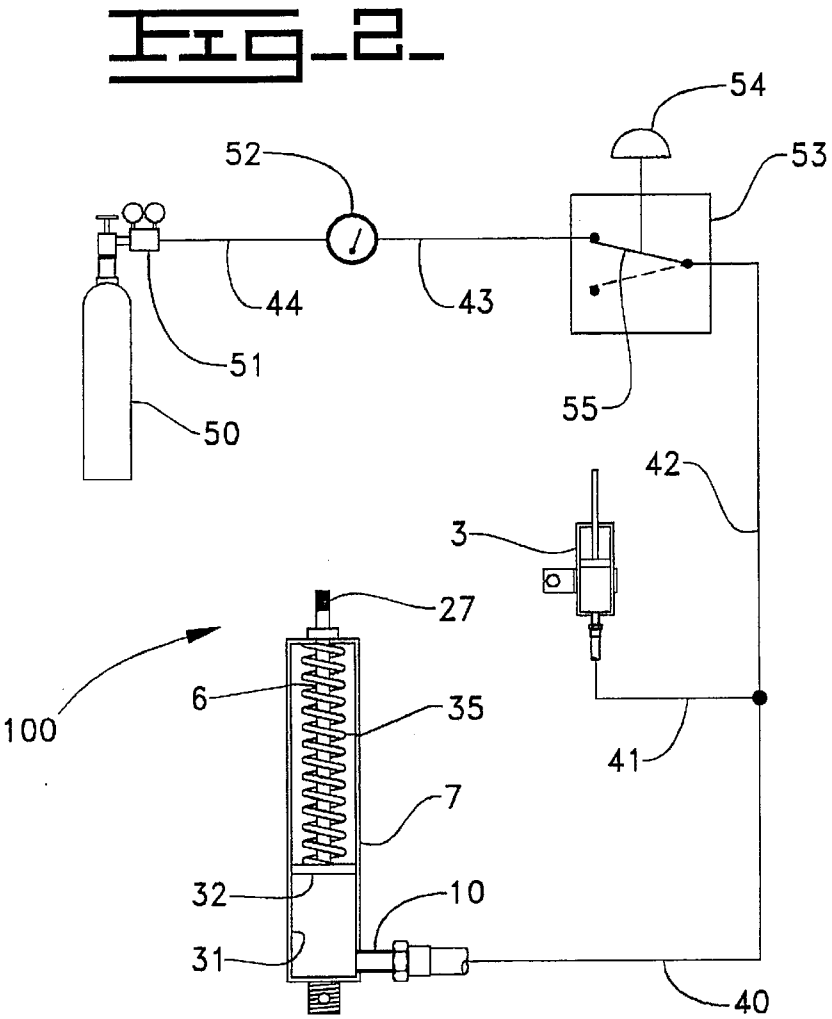
FIG. 2 is a schematic view of the automatic golf ball teeing machine of FIG. 1.

Referring now to FIG. 2, compressurized fluid is supplied to automatic golf ball teeing machine 100 from a typical container 50 of compressed gas. A pressure regulator 51 lowers the pressure from container 50 to a steady and known constant. It has been found that 15 to 20 pounds of pressure is more than enough to feed a multitude of machines 100 connected to a single source of pressurized gas. Also, an air compressor could be substituted for the container 50 shown. The compressed gas leaving pressure regulator 51 travels along a pipe 44 through a variable pressure regulator 52 and into a second pipe 43. Variable pressure regulator 52 is preferably mounted at a location accessible to the golfer, such as on the hopper so that the golfer can adjust the pressure acting on the pneumatic cylinders and infinitely control the height at which each successive golf ball is teed without changing their stance. Pipe 43 is connected to a reset switch 53 which is also preferably mounted at a location accessible to the golfer, so that each successive ball can be teed without the golfer having to change his stance. Reset switch 53 includes an internal conduit 55 which is normally biased to open pipe 43 to supply pipe 42. However, when push button 54 is depressed, internal conduit 55 causes the pressurized gas within pipe 42 to vent to the atmosphere. This causes both pneumatic cylinders 7 and 3 to retract under their internal biasing means as the compressed gas escapes. Branch pipes 41 and 40 that supply the pneumatic cylinders are connected to pipe 42 as shown.

Figure 3:
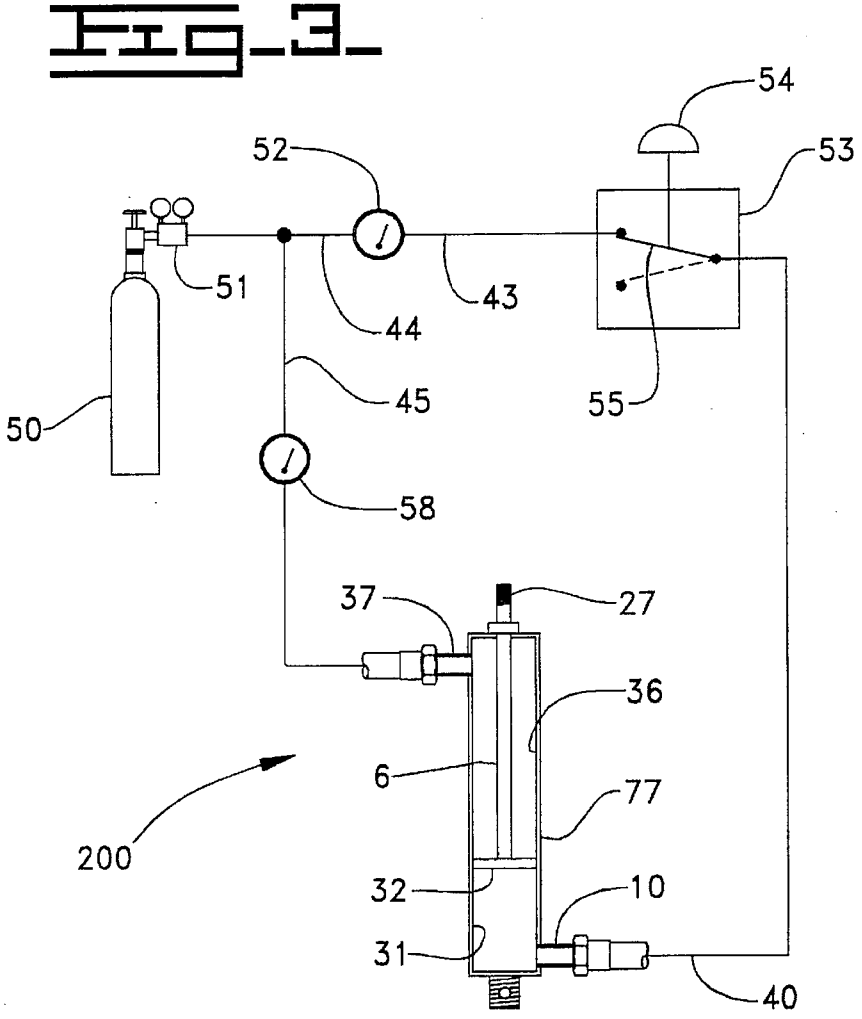
FIG. 3 is a schematic view of an automatic golf ball teeing machine according to a second embodiment of the present invention.

Referring now to FIG. 3, an automatic golf ball loading machine 200 according to a second embodiment of the present invention utilizes pressure balancing in order to adjust the height of the golf ball instead of a compression spring biasing means as in the previous embodiment. Many of the items shown in machine 200 are identical to that of the previous embodiment and will not be described again. What is different is that pneumatic cylinder 77 includes a first inlet 10 located below piston 32 and a second inlet 37 that opens to chamber 36 above piston 32. A branch pipe 45 from pipe 44 leads to a fixed pressure regulator 58 that sets the air pressure acting on the upper side of piston 32 to a medium pressure, such as 5 psi. Thus, piston rod 6 will rise under the action of the higher pressure entering inlet 10 until the pressure forces acting above and below piston 32 are balanced. Like the previous embodiment the golfer has the ability to adjust this balance position by adjusting the pressure in variable pressure regulator 52. When reset switch 53 is activated, pressurized fluid under piston 32 is vented to the atmosphere while the steady pressure acting above the piston biases it toward its retracted position in order to reload another golf ball.

Figure 4:
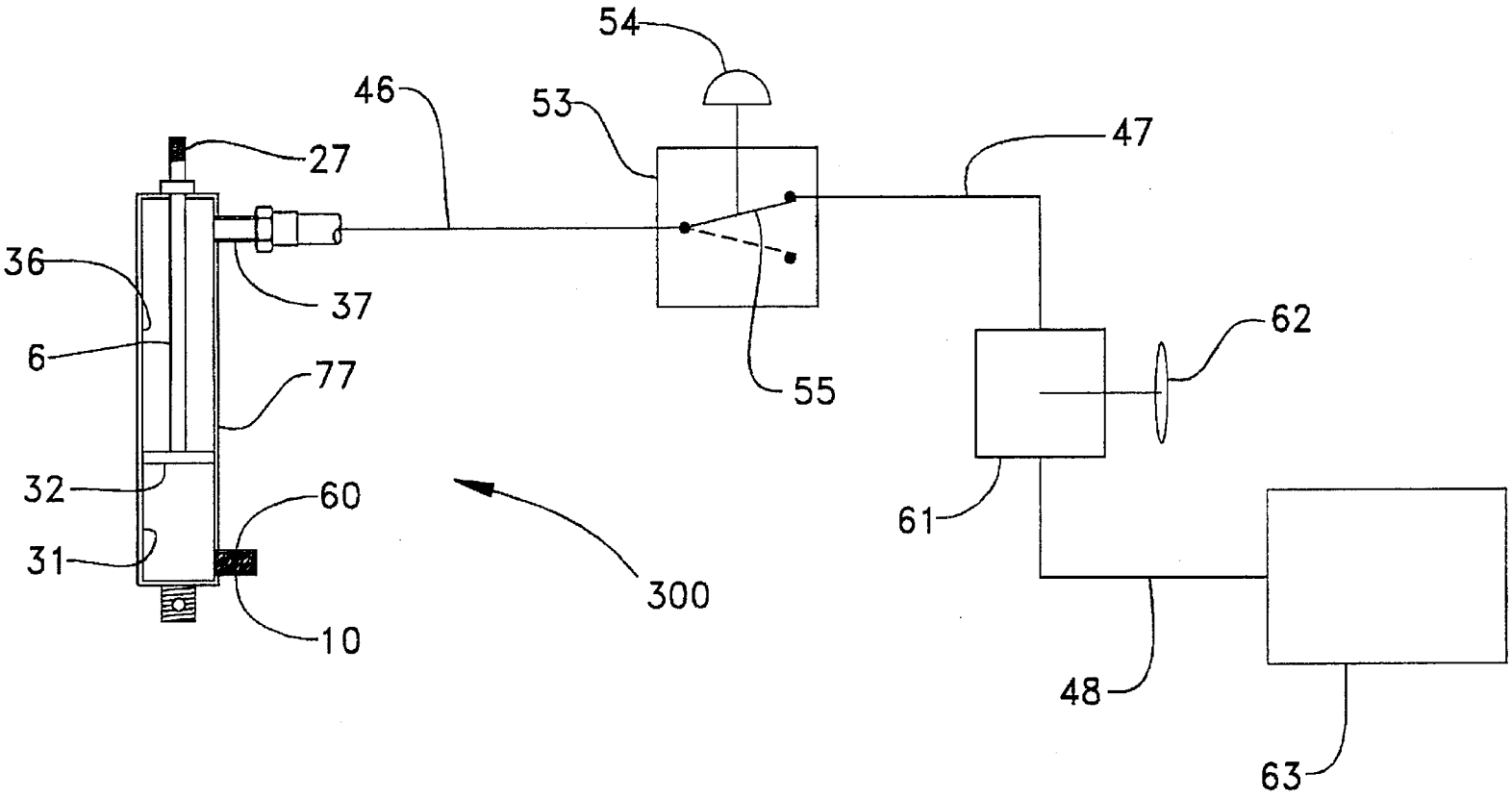
FIG. 4 is a schematic illustration of still another embodiment of an automatic golf ball teeing machine according to the present invention.

Referring now to FIG. 4, still another embodiment of the present invention utilizes a vacuum to control the ball's height. Like the previous embodiment, pneumatic cylinder 77 includes a lower inlet 10 and an upper inlet 37 that act on the underside and top side, respectively, of piston 32. In this case, inlet 10 is open to the atmosphere and includes a filter 60 that prevents debris or dirt from entering into pneumatic cylinder 77. The upper inlet 37 of cylinder 77 is connected to a vacuum pump 63 via pipes 46, 47 and 48. A reset switch 53 of a type already described is mounted between pipes 46 and 47. When button 54 is depressed, internal conduit 55 opens inlet 37 to atmosphere so that piston 32 and piston rod. 6 retract under the force of gravity due to their own inertia. Internal conduit 55 is normally biased to connect pipe 46 to pipe 47 so that piston 32 rises as internal area 36 becomes a vacuum. The higher the vacuum, the higher the position at which the ball will become teed. To vary the height of the ball, a purge valve 61 allows air to break the vacuum so that an accurate regulation can be obtained. Purge valve 61 is operated by a push button 62.

Those skilled in the art will appreciate that although the present invention has been illustrated as utilizing compressed gas, a pressurized liquid could also be used. For instance, pressurized water could be supplied to such an alternative system simply by providing an elevated tank of water or another suitable fluid. In any event, the present invention is not intended to be limited only to pneumatic cylinders, but could also utilize hydraulics that exploit pressure differentials in a manner identical to that previously described. The various components of the present invention are commercially available from various vendors, such as Mead Corporation for the pneumatic cylinders and Johnson Controls for the pressure regulating valves. As an alternative to a hopper, the golf ball supply conduit of the present invention could be connected to a vending machine that loads the conduit with a number of balls for each payment.

The machines of the present invention are suitable for being connected in parallel to a single source of pressurized fluid. The machine provides a simple device for a golfer practicing their swing to tee successive golf balls at a desired height without having to change their stance, and depending upon the shape and location of controls, also without having to lose their grip. It should be understood that the above description is intended for illustrative purposes only and should not be interpreted in any way to limit the scope of the present invention which is defined solely in terms of the claims as set forth below.

I claim:

1. An automatic golf ball teeing machine comprising:

a housing that includes a substantially horizontal plate;

a fluid pressure cylinder with an inlet and a piston above said inlet, and being attached to said housing below said plate, and said piston being moveable between an advanced position and a retracted position;

means for biasing said piston toward said retracted position;

a tee connected to said piston and being moveable with said piston between a loading position and a maximum height position in which a portion of said tee extends above said plate;

a supply conduit sized to carry golf balls attached to said housing with one end adjacent said tee when in said loading position;

a source of high pressure fluid connected to said inlet of said fluid pressure cylinder;

a pressure regulating valve positioned between said inlet and said source of high pressure fluid and being capable of adjusting pressure acting on said piston to balance said tee between said loading position and said maximum height position; and a reset switch capable of relieving pressure on said piston to allow said piston to retract under the action of said means for biasing.

2. The machine of claim 1 wherein said means for biasing includes a spring in contact with said piston.

3. The machine of claim 2 wherein said spring is a compression spring in contact with said piston.

4. The machine of claim 1 wherein said fluid pressure cylinder is a pneumatic cylinder; and said source of high pressure fluid is a container of compressed gas; and said reset switch having a first position that opens said inlet to atmospheric pressure and a second position that opens said inlet to said container of compressed gas.

5. The machine of claim 1 wherein said fluid pressure cylinder has a vertical actuation axis; and said tee is aligned with said axis.

6. The machine of claim 1 wherein said means for biasing includes said fluid pressure cylinder having a second inlet above said piston; and said second inlet being connected to a source of medium pressure fluid.

7. The machine of claim 6 wherein said fluid pressure cylinder is a pneumatic cylinder;

said source of high pressure fluid is a first container of compressed gas; and said source of medium pressure fluid is a second container of compressed gas.

8. The machine of claim 7 wherein said first container and said second container are a single container of compressed gas at a high pressure; and a pressure regulator positioned between said single container and said second inlet.

9. The machine of claim 1 wherein said means for biasing includes a weight of said piston.

10. The machine of claim 9 wherein said fluid pressure cylinder has a port above said piston;

said port is connected to a pump inlet; and said reset switch having a first position that opens said inlet to atmospheric pressure and a second position that opens said inlet to said pump inlet.

11. An automatic golf ball teeing machine comprising:

a housing that includes a substantially horizontal plate;

a pneumatic cylinder with an inlet and a piston above said inlet, and being attached to said housing under a hole in said plate, and said piston being moveable along a vertical actuation axis between an advanced position and a retracted position;

means for biasing said piston toward said retracted position that includes a compression spring in contact with said piston;

a tee connected to said piston and being moveable with said piston along said vertical actuation axis between a loading position and a maximum height position in which a portion of said tee extends above said plate;

a supply conduit sized to carry golf balls attached to said housing with one end adjacent said tee when in said loading position;

a source of compressed gas connected to said inlet of said pneumatic cylinder;

a pressure regulating valve positioned between said inlet and said source of high pressure fluid and being capable of adjusting pressure acting on said piston to balance said tee between said loading position and said maximum height position; and said reset switch having a first position that opens said inlet to atmospheric pressure and a second position that opens said inlet to said container of compressed gas.

12. The machine of claim 11 wherein said reset switch is located at a position accessible to a golfer hitting golf balls from said tee without the golfer having to change his stance.

13. The machine of claim 12 wherein said pressure regulating valve is accessible to a golfer hitting golf balls off said tee without the golfer having to change his stance.

* * * * *